United States Patent [19]

Nakamura

[11] Patent Number: 4,638,718

[45] Date of Patent: Jan. 27, 1987

[54] FLUID-PRESSURE DRIVING DEVICE

[75] Inventor: Ichiro Nakamura, Katsuta, Japan

[73] Assignee: Hitachi, Ltd., Tokyo, Japan

[21] Appl. No.: 664,847

[22] Filed: Oct. 25, 1984

[30] Foreign Application Priority Data

Oct. 28, 1983 [JP] Japan ..... 58-200924

[51] Int. Cl.[4] ..... F15B 15/17

[52] U.S. Cl. ..... 91/178; 91/183; 91/396; 91/417 R; 92/62; 92/65

[58] Field of Search ..... 92/65, 62; 91/178, 183, 91/396, 415, 417 R

[56] References Cited

U.S. PATENT DOCUMENTS

| | | | |
|---|---|---|---|
| 787,480 | 4/1905 | Tanner | 92/65 |
| 3,312,146 | 4/1967 | Ouere et al. | 92/65 |
| 3,623,694 | 11/1971 | Goldberg | 92/65 |
| 4,289,063 | 9/1981 | Nakamura | 91/306 |

FOREIGN PATENT DOCUMENTS

| | | | |
|---|---|---|---|
| 1432226 | 4/1976 | United Kingdom | 92/65 |

*Primary Examiner*—Robert E. Garrett
*Assistant Examiner*—Mark A. Williamson
*Attorney, Agent, or Firm*—Antonelli, Terry & Wands

[57] ABSTRACT

A fluid-pressure driving device including a main actuator unit having a piston adapted to travel a full part of a predetermined stroke and an accelerating actuator unit having a piston adapted to travel only a part of the stroke and being capable of operating only during the acceleration of the object to be actuated. These actuator units are operated under the control of a control valve such that, in the accelerating range in which the speed of the object is still low, both actuator units operate to produce a large actuating force, while, after the acceleration, only the main actuator unit operates to fully travel the required stroke.

5 Claims, 6 Drawing Figures

FLUID-PRESSURE DRIVING DEVICE

BACKGROUND OF THE INVENTION

The present invention relates to a fluid-pressure driving device suitable for actuating a device such as a circuit breaker requiring a high speed operation and high response characteristics.

As is well known, high operation speed is an important requisite for circuit breakers. The current trend for greater electric power supply and larger transmission capacity has given a rise to the demand for circuit breakers having greater capacities and operable at higher voltages. On the other hand, there is a demand for higher transient stability in the electric power transmission system. In view of the above, it is highly desirable to attain a higher interrupting speed, i.e., a shorter breaking time. The shortening of the breaking time will be achieved mainly through a shortening of the arcing time and an increase in the operation speed of an actuator which separate the contactors of the circuit breaker.

In for example, U.S. Pat. No. 4,289,063 a fluid-pressure driving is proposed which includes a fluid-pressure driving device unit and a control valve for controlling this unit. Needless to say, a circuit breaker having a large capacity employs a movable part of a large mass which, in turn, requires a large actuating power when quickly accelerated because of a larger inertial force. Consequently, the size and power of the actuator has to be increased correspondingly. The greater capacity of the fluid-pressure driving device inevitably requires a large flow rate of the working fluid, particularly when it is required to operate at a high speed. Consequently, the size and weight of the movable part in the control valve of the device are increased to exhibit a greater inertial force, resulting in a delay of response to the operating instruction. This known fluid-pressure driving device, therefore, is still unsatisfactory from the view points of operation speed and response characteristics.

It is to be pointed out also that the fluid-pressure driving device requires a large displacement or volume of fluid moved in each operation cycle, necessitating a pressurized fluid source of a large capacity.

SUMMARY OF THE INVENTION

Accordingly, an object of the invention is to provide a small-sized fluid-pressure driving device capable of actuating an object at a high speed and with good response characteristics, even when the object was a large inertial force.

To this end, according to the invention, a fluid-pressure driving device is provided in which the actuating power is produced by controlling a pressurized working fluid from a source by a control valve which operates in response to an operation instruction, with the actuator comprising a main actuator unit capable of travelling a predetermined stroke and an accelerating actuator unit which operates only during acceleration of the object to be actuated and which is capable of travelling a small stroke. The main actuator unit and the accelerating actuator unit are coaxially disposed with, the accelerating actuator unit having a piston which is slidably carried by a rod connected to a piston of the main actuator unit.

The above and other objects, features and advantages of the invention will become more apparent from the following description of the preferred embodiments when the same is read in conjunction with the accompanying drawings.

BRIEF DESCRIPTION OF THE DRAWINGS

FIG. 3*a* is a graphical illustration of a travel of a piston; while

DETAILED DESCRIPTION

Preferred embodiments of the invention will be described hereinunder with reference to the accompanying drawings.

Figure 1:
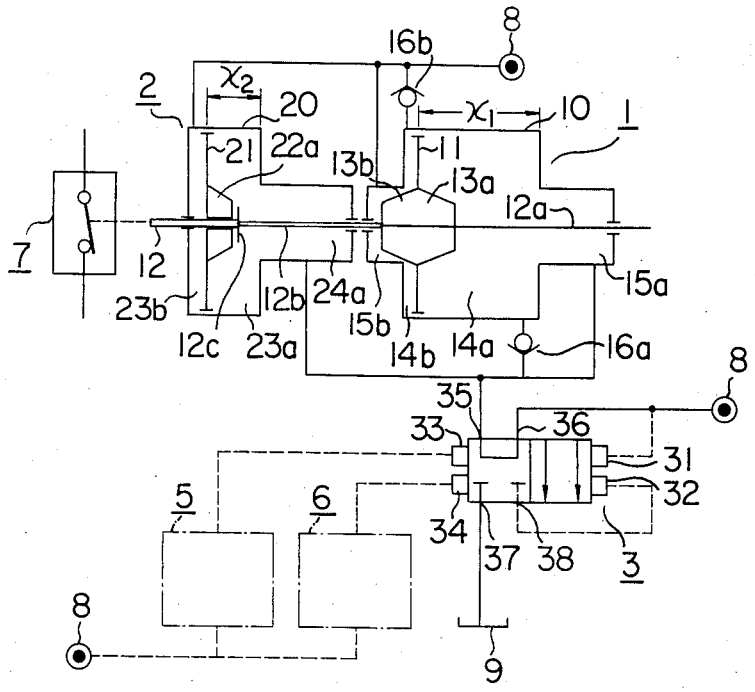
FIG. 1 is a circuit diagram of a fluid circuit incorporated in an embodiment of a fluid-pressure driving device in accordance with the invention.

Referring now to the drawings wherein like reference numerals are used throughout the various views to designate like parts and, more particularly, to FIG. 1, according to this figure, a fluid-pressure driving device comprises a driving section including a main actuator unit 1 and an accelerating actuator unit 2, with the main actuator unit 1 being adapted to travel a stroke $X_1$ while generating an actuating force $F_1$. The accelerating actuator unit 2 operates only when it is desired to start and accelerate the object to be actuated, i.e., a circuit breaking section 7, and is adapted to travel a stroke $X_2$ while producing a force $F_2$. The stroke $X_2$ is substantially equal to the distance to be travelled until the circuit breaking section 7 is fully accelerated. The actuator units 1 and 2 are controlled by a main control valve 3 which, in turn, is controlled by two auxiliary control valves 5 and 6. The main actuator unit 1 and the accelerating actuator unit 2 are arranged coaxially.

The main actuator unit 1 includes a cylinder body 10, piston 11, rod 12*a* and piston bosses 13*a*, 13*b* with four fluid chambers 14*a*, 14*b*, 15*a* and 15*b* being defined in the cylinder body 10 of the main actuator unit 1. The fluid chamber 15*b* directly communicates with a pressurized fluid source 8 to which is also communicated through a check valve 16*b*, to the fluid chamber 14*b*. On the other hand, the fluid chamber 15*a* is in direct communication with the main control valve 3, while the fluid chamber 14*a* communicates the main control valve 3 through a check valve 16*a* and through fluid chamber 15*a* the diameter of the rod 12*b* extending leftwardly from the piston 11 is larger than that of the rod 12*a* extending rightwardly from the piston 11. Consequently, the pressure receiving area of the right side surface of the piston 11 is larger than that of the left side surface of the piston 11.

The accelerating actuator 2 is composed of a cylinder body 20, piston 21 and a piston boss 22*a*. The cylinder body 20 defines therein three to four fluid chambers. In the illustrated embodiment, there are three fluid chambers 23*a*, 23*b* and 24*a*. A rod 12*b* extends axially slidably through a bore formed in the piston boss 22*a* of the piston 21. The rod 12*b* is adapted to actuate a contactor in the circuit breaking section 7, through the action of a rod 12. The piston 21 of the accelerating actuator 2 is movable in the axial direction irrespective of the movement of the rod 12*b*. The fluid chamber 23*b* communicates the pressurized fluid source 8, while the fluid chamber 24*a* communicates the main control valve 3. A stopper 12*c* is provided on the rod 12*b* the diameter of the rod extending leftwardly from the stopper 12*c* is larger than that of the rod extending rightwardly from the stopper 12*c*. Consequently, the pressure receiving area on the right side surface of the piston 21 is larger than that of the left side surface of the piston 21.

The main control valve 3 is a two-position control valve adapted to selectively open and close the fluid passages between the actuator units 1, 2 and the source 8 and a drain tank 9. Namely, when the main control valve 3 is in the illustrated position, a port 35 of the main control valve 3 provides a communication between the pressurized fluid source 8 and the two actuator units 1 and 2, whereas, when the main control valve 3 is shifted to the right block of the main control valve 3, the port 35 allows the actuator units 1 and 2 to communicate the drain tank 9. Which one of two positions is to be taken is determined by the fluid pressures received by four pressure receiving portions 31, 32, 33 and 34 of this main control valve 3. assuming that the forces to be applied on the pressure receiving portions 31, 32, 33 and 34 are $F_{31}$, $F_{32}$, $F_{33}$, and $F_{34}$, respectively, the pressure receiving portions are formed such that $F_{34}<F_{31}<F_{33}<F_{31}+F_{32}<F_{33}$ and $F_{34}$. The auxiliary control valves 5 and 6 serve to control the fluid pressures which act on the pressure-receiving portions 33 and 34, thereby controlling the main control valve 3. The auxiliary control valve 5 serves to release the fluid pressure of the pressure receiving portion 33 in response to the construction, and the auxiliary control valve 6 serves to apply the fluid pressure on the pressure receiving portion 34 in response to the instruction.

The operation of this embodiment of the actuator is as follows.

In FIG. 1, the main control valve 3 has been moved to the illustrated position so that the pistons 11 and 21 in the main and accelerating actuators 1 and 2 have been moved to the left so as to maintain the contactor in the circuit breaking section 7 in the closed state. In this state, the fluid pressures are applied to the pressure receiving portions 31, 33 of the main control valve 3 to hold the latter in the illustrated position. When a circuit breaking instruction is given to the auxiliary control valve 5, the pressurized fluid in the pressure-receiving portion 33 is relieved to bring the force $F_{33}$ to zero and only force $F_{31}$ is applied to the main control valve 3 so that the main control valve 3 is shifted to the right block of the main control valve 3, so that the actuator port 35 is brought into communication with the tank port 37 while a fluid source port 36 is made to communicate with a pilot port 38. Consequently, the pressure of the fluid is applied to the pressure-receiving portion 32, while the pressurized fluid in the fluid chamber 14*a* in the actuator unit 1 is relieved to the drain tank 9 through the fluid chamber 15*a*, and the pressurized fluid in the fluid chamber 24*a* in the actuator unit 2 is directly relieved to the tank 9. In this state, pressurized fluid is introduced from the source 8 into the fluid chambers 14*b*, 15*b* and 23*b* so that the pistons 11 and 21 are displaced to the right to separate the contact of the circuit breaking section 7 from the circuit by pulling the rod 12. When the piston 11 of the main actuator 1 operates, the piston 21 of the accelerating actuator 2 is simultaneously operated simultaneously to exert an additional force $F_2$ through the stopper 12*c* so that the sum of forces $(F_1+F_2)$ is transmitted to the circuit breaking section 7. When the movable part of the circuit breaking section 7 has been accelerated substantially to the desired speed, the piston boss 22*a* of the piston 21 in the accelerating actuator unit 2 comes into the fluid chamber 24*a*. In this state, the high-pressure fluid in the fluid chamber 23*a* can flow into the fluid chamber only through a restricted passage, namely, an annular passage formed between the outer peripheral surface of the piston boss 22*a* and the inner peripheral surface of wall of the fluid chamber 24*a*, so that the fluid pressure in the fluid chamber 23*a* is increased and, as a result, the piston 21 is decelerated and stopped. Consequently, the rod 12 is freed from the piston 21, and is solely actuated by the main actuator unit 1. Namely, the piston 11 of the main actuator unit 1 is further moved to the right until it is decelerated and stopped as the piston boss 13*a* comes into the fluid chamber 15*a*. The circuit breaking instruction given to the auxiliary control valve 5 is dismissed when the main control valve 3 is switched, so that the main control valve 3 maintains this position although the auxiliary control valve 5 is reset to the original position.

The operation for bringing the contactor of the circuit breaking section 7 is made under the control of the auxiliary control valve 6.

As the circuit closing instruction is given to the auxiliary control valve 6, the high-pressure fluid is supplied to the pressure-receiving portion 34 of the main control valve 3. As a result, the forces $F_{31}$, $F_{32}$, $F_{33}$ and $F_{34}$ are applied to the main control valve 3 resulting in the relationship of $F_{31}+F_{32}<F_{33}+F_{34}$ whereby the main control valve 3 is switched to resume the position shown in FIG. 1, the high pressure fluid is also supplied to the fluid chambers 14*a*, 15*a* on the righthand side of the piston 11 and 23*a*, 24*a* on the right hand side of the piston 21. In this connection, a force in the leftward direction is applied to each piston because the pressure receiving area of the right side surface of each piston is larger than that of the left side surface of the piston. so that the pistons 11 and 21 are moved to the left as viewed in FIG. 1 to actuate the rod 12 to thereby bring the contact of the circuit breaking section 7 to close the circuit.

The fluid-pressure driving device of the invention offers the following advantages.

The conventional fluid-pressure driving device of the type described employs a single actuator adapted to travel the stroke distance X and capable of producing a force F which equals to the sum of $F_1$ and $F_2$ produced by both actuator units in the actuator of the invention. Representing the pressure receiving area of the piston in the single actuator unit of the conventional actuator by $AP_3$ and the piston velocity by v (maximum velocity by v max), the flow rate $Q_3$ of the fluid flowing in the control valve is given by $Q_3=AP_3$ v, while the volume $V_3$ of the fluid consumed is given as $V_3=AP_3 X$.

In the case of the described embodiment of the fluid-pressure driving device of the invention, the pressure receiving areas and the piston velocities in the main actuator unit 1 and the accelerating actuator unit 2 by $AP_1$, $v_1$ and $AP_2$, $v_2$, respectively, wherein the pressure receiving areas $AP_1$ and $AP_2$ meet the condition of $AP_3=AP_1+AP_2$. In this case, the flow rate of the fluid flowing in the main control valve 3 is given as $Q=(AP_1 v_1+AP_2 v_2)$, while the volume of the fluid consumed is given by $V=AP_1X_1+AP_2X_2$. As will be explained later, the following conditions are met in regard to the flow rate and the volume of the fluid consumed:

$$Q<Q_3,\ V<V_3.$$

It is thus possible to reduce the sizes of the main control valve 3 and auxiliary control valves 5, 6, as well as the size of the actuator units 1 and 2. It is, therefore, possible to attain a high operation speed and good response characteristics of the actuator, while decreasing the volume of the fluid consumed.

In the embodiment described above, in view of the fact that the circuit breaker requires a high operation speed particularly in the circuit breaking operation rather than in the circuit closing operation, the accelerating actuator unit 2 is designed and constructed to accelerate the contact of the circuit breaking section 7 unidirectionally only in the circuit breaking direction. This, however, is not exclusive and the invention can be carried out in such a way as to accelerate the object in both directions, i.e., to accelerate the contact of the circuit breaking section 7 both in the circuit breaking direction and the circuit closing direction.

Figure 2:
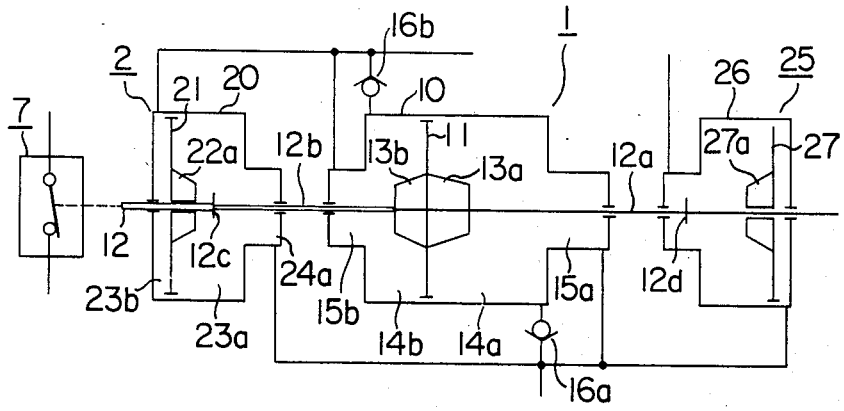
FIG. 2 is a circuit diagram of a fluid circuit incorporated in another embodiment of a fluid-pressure driving device in accordance with the present invention.

In FIG. 2, wherein the contact in the circuit breaking section 7 is accelerated in both directions, an accelerating actuator unit, separate from accelerating actuator unit 2 is disposed at the opposite side (right side as viewed in FIG. 2) of the main actuator unit 1 to the accelerating actuator unit 2. The accelerating actuator unit 25 has a body 26, piston 27, piston boss 27*a* and a stopper 12*d*, with the operation of this embodiment not being further described, because it is same as that of the accelerating actuator unit 2.

Figure 3A:
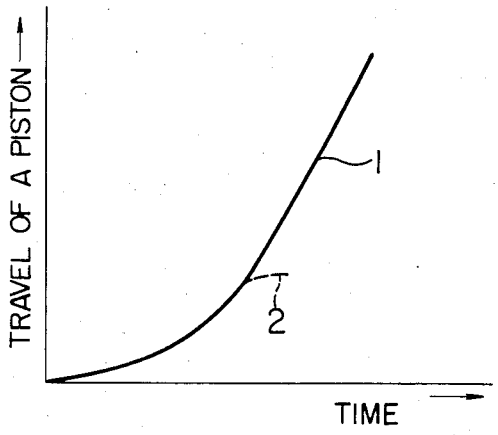
Figure 3B:
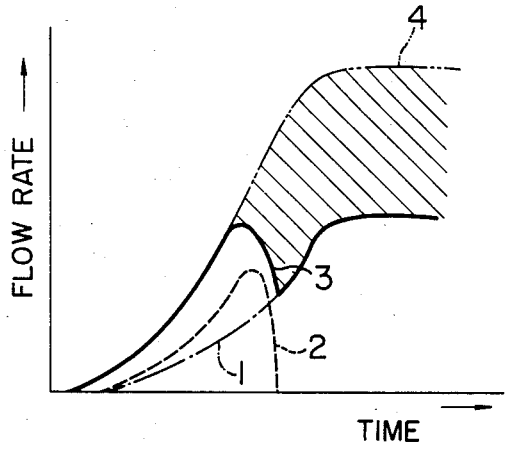
FIG. 3*b* is a graphical illustration of the flow rate of a pressurized fluid flowing in a main control valve.

FIGS. 3*a* and 3*b* show, respectively, the travel or displacement of the pistons 11, 21 in the actuator units and the flow rate of the pressurized fluid in the main control valve 3 in the actuator of the invention during the circuit breaking operation. When the circuit breaking instruction is given to the main control valve 3, the main control valve 3 is switched to allow the pressurized fluid to be discharged from the fluid chambers 14*a*, 24*a* and the pistons 11 and 21 of the main and accelerating actuator units 1 and 2 are started and accelerated. In the beginning period of operation, the pistons 11 and 21 operate at an equal velocity and the pressurized fluid is discharged from the cylinders of respective actuator units at the flow rates expressed by curves (1) and (2) in FIG. 3*b*. The flow rate of the fluid in the main control valve 3 is shown by a curve (3) which is the sum of the values of the curves (1) and (2). The deceleration of the piston 21 in the accelerating actuator 2 is commenced when the rod 12 has been accelerated almost to the maximum speed by the pistons 11, 21. Namely, the piston 21 of the accelerating actuator unit 2 moves as shown by a broken-line curve (2) in FIG. 3*a*, while the piston 11 of the main actuator unit 1 continues to move as shown by the full-line curve (1) in FIG. 3*a*. Consequently, the rate of discharge of the pressurized fluid from the accelerating actuator unit 2 is gradually decreased and, after the piston 21 in the accelerating actuator unit 2 is stopped, only the fluid from the main actuator 1 flows through the main control valve 3. Thus, the flow rate of the fluid in the main control valve 3 changes as shown by a curve (3) in FIG. 3*b*. For obtaining the actuating force $F=F_1+F_2$ with the conventional arrangement, the piston in the sole actuator unit has to be moved following the curve (1) in FIG. 3*a*, so that the flow rate of the pressurized fluid in the main control valve is changed as shown by a curve (4) in FIG. 3*b*. Thus, the fluid-pressure driving device of the invention can reduce the flow rate by an amount which corresponds to the hatched area in FIG. 3*b*. The volume of the fluid consumed can be decreased correspondingly.

Figure 4:
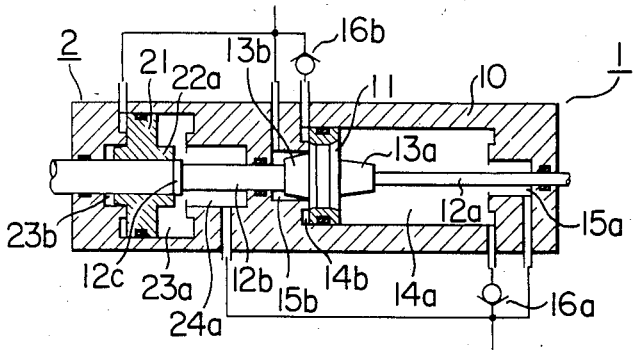
FIG. 4 is a sectional view of an actuator unit incorporated in the fluid-pressure driving device in accordance with the invention.

FIG. 4 shows examples of practical construction of the main and accelerating actuator units 1 and 2.

Figure 5:
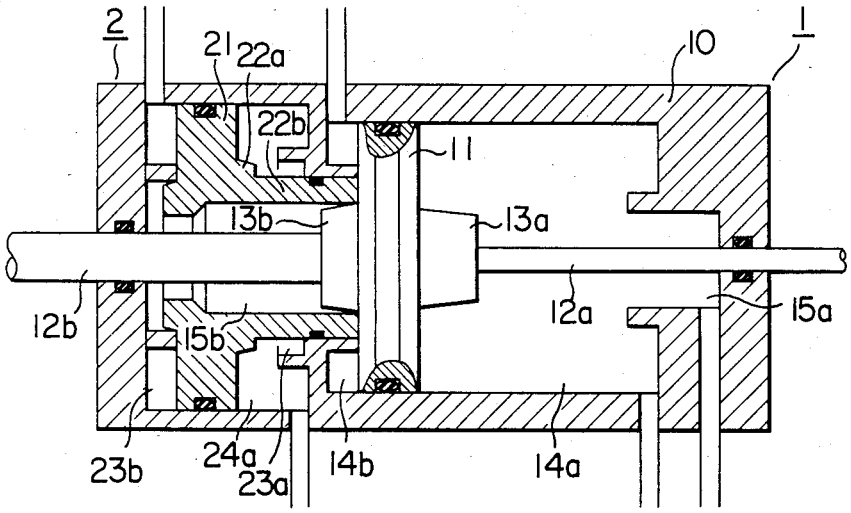
FIG. 5 is a sectional view of another example of a fluid-pressure driving device of the invention.

In the modified accelerating actuator unit 2 of FIG. 5, the piston 21 has a stem 22*b* on the piston boss 22*a*, such that a fluid chamber 15*b* is formed in the hollow of the piston 21 receiving the rod 12*b*. In addition, the piston boss 13*b* of the main actuator unit 1 is adapted to be moved into the fluid chamber 15*b*. The fluid chamber 15*b* is adapted to be supplied with pressurized fluid through a fluid chamber 23*b*. In this modification, the stopper 12*c* used in the foregoing embodiments can be eliminated, because the piston 11 itself functions as the stopper.

As has been described, according to the invention, a large actuating power is produced by the cooperation of the main and accelerating actuator units 1, 2 in the beginning part of the stroke in which the piston speed is still low and the flow rate of the fluid is still small and, after the rod has been accelerated to a high speed, the actuating force is solely produced by the main actuator 1. It is thus possible to attain a large actuating force and, hence, a high operation speed in the operating region where a high operation speed is specifically required, without necessitating any increase of the size of the control valve. Consequently, the fluid-pressure driving device of the invention can be constructed to have reduced size and weight, so that the inertial force is decreased to ensure a high speed of operation and good response characteristics.

What is claimed is:

1. A fluid-pressure driving device having a control valve means operable in response to an operation instruction and an actuator means in which actuating power is produced by a pressurized working fluid from the control valve means, said actuator means comprising:

a main actuator unit displaceable over a predetermined stroke;

an accelerating actuator unit separate from and coaxially disposed in relation to said main actuator unit and having a smaller stroke displacement than that of said main actuator unit;

said main actuator unit having a piston, a rod, and fluid chambers on both sides of said main actuator unit piston;

said accelerating actuator unit having a piston and fluid chambers on both sides of said accelerating actuator unit piston, which is displaceable along said rod such that both pistons move together in a low accelerating speed range while only said main actuator unit piston moves after acceleration beyond the range; and one of said chambers of said main actuator unit communicate with a source of the pressurized working fluid through a check valve, while the remaining chamber of said main actuator unit communicates with the source of pressurized working fluid through another check valve, said piston of said main actuator unit having a projecting cushioning portion, one of said chambers of said accelerating actuator unit communicates with the source of said pressurized working fluid while the other of said chambers of said accelerating unit communicates with said control valve means, wherein said control valve means drives said main actuator unit and said accelerating actuator unit in response to an operation instruction.

2. A fluid-pressure driving device according to claim 1, wherein said accelerating actuator unit is disposed at one side of said main actuator unit, and wherein said rod includes a stopper which transmits the force of said piston of said accelerating actuator unit to said rod only when said piston of said accelerating actuator unit operates in one direction.

3. A fluid-pressure driving device according to claim 1, wherein one accelerating actuator unit is disposed at each side of said main actuator unit, each of said accelerating actuator units includes pistons, while said rod is provided with stoppers adapted to transmit the force of said pistons of said accelerating actuator units when these pistons move in respective directions.

4. A fluid-pressure driving device according to claim 2, wherein a fluid chamber is formed by an inner peripheral surface of said piston of said accelerating actuator unit and said rod, said fluid chamber constituting a passage through which the pressurized working fluid is charged and discharged to and from said main actuator unit.

5. A fluid-pressure driving device according to claim 4, wherein the piston of said main actuator unit and the piston of said accelerating actuator unit contact with each other when said pistons are disposed at one stroke end thereof, so that said piston of said main actuator unit serves as the stopper for said accelerating actuator.

* * * * *